United States Patent [19]

Swartz et al.

[11] 4,328,483

[45] May 4, 1982

[54] MULTIPLEXED-DEMULTIPLEXED SYNCHRO DEMODULATION APPARATUS

[75] Inventors: Harold L. Swartz, Glendale; Harry D. Smith, Scottsdale; Terrence L. Grimes, Phoenix, all of Ariz.

[73] Assignee: Sperry Corporation, New York, N.Y.

[21] Appl. No.: 117,886

[22] Filed: Feb. 1, 1980

[51] Int. Cl.[3] ..... G08C 11/00

[52] U.S. Cl. ..... 340/347 SY; 318/654; 364/816

[58] Field of Search ..... 340/347 SY; 364/815, 364/816, 817, 818; 318/654, 655, 661; 328/1

[56] References Cited

U.S. PATENT DOCUMENTS 3,848,172 11/1974 Thomas ..... 318/654

*Primary Examiner*—Charles D. Miller

*Attorney, Agent, or Firm*—Howard P. Terry; Albert B. Cooper

[57] ABSTRACT

The outputs of a three-wire synchro are applied to a multiplexer which provides the multiplexed synchro outputs to an amplifier and demodulator. The demodulated synchro outputs are applied to a demultiplexer whose outputs are filtered to provide demodulated d.c. voltages corresponding to the synchro output signals. The demodulated d.c. voltages are applied to a conversion circuit for providing the sine and cosine of the angular position of the three-wire synchro device. The multiplexer, demultiplexer and demodulator are synchronized by the synchro a.c. reference signal.

11 Claims, 3 Drawing Figures

MULTIPLEXED-DEMULTIPLEXED SYNCHRO DEMODULATION APPARATUS

BACKGROUND OF THE INVENTION

1. Field of the Invention

The invention relates to synchro devices particularly with respect to apparatus for demodulating synchro output signals into corresponding d.c. signals.

2. Description of the Prior Art

Three-wire synchro devices are commonly utilized for sensing the angular position of members. The rotor of the synchro device is coupled to the member with an a.c. excitation signal applied to the excitation winding of the synchro device. The excitation signal is coupled from the excitation winding to the output windings of the synchro device to provide three a.c. signals amplitude modulated in accordance with the angular position of the rotor and either in phase or out of phase with the excitation signal in accordance with the rotor position. In typical applications, the three-wire signals from the synchro device are converted to two-wire a.c. signals proportional to the sine and cosine of the rotor angle via a Scott-T transformer. The sine and cosine outputs from the Scott-T transformer are conventionally converted into d.c. sine and cosine signals via respective synchronous demodulators connected to the sine and cosine outputs of the transformer. In digital systems the d.c. sine and cosine signals may be converted into digital format via an analog-to-digital converter and applied to a microprocessor for appropriate computations.

This arrangement suffers from the disadvantage that gain discrepancies between the sine and cosine channels of the apparatus result in errors in the ultimate angular output rendering the apparatus commercially unacceptable. These gain discrepancies have heretofore only been alleviated by complex and tedious component matching with respect to the two channels or by undesirable trimming circuitry and procedures. Primarily the problem exists in the demodulators utilized in the apparatus. Ideally the demodulators should be identical with respect to each other but as a practical matter they are not, requiring extensive and costly calibration. Not only are the adjustments of the two channels to obtain identical gain with respect to each other tedious and undesirable, but the gains of the two channels tend to drift with time and temperature or other environmental factors, to reduce the device accuracy to unacceptable values. Additionally, Scott-T transformers tend to be bulky, heavy and expensive, particularly with respect to precision transformers wherein the sine and cosine channels are closely matched.

An alternative prior art arrangement may utilize the well known electronic Scott-T circuit in place of the Scott-T transformer. Such circuits also require precisely matched components with respect to the sine and cosine channels to provide the required accuracy and additionally require numerous expensive and bulky circuit elements for their implementation.

Thus it is appreciated that unless bulky and expensive circuitry and components were utilized that required precise matching and tedious trimming, the sine and cosine values applied to the digital processor would be so inaccurate as to result in commercially unacceptable accuracy in the ultimate angular result.

It is, therefore, a desideratum of the present invention to provide accurate angular data from synchro devices without the attendant extensive and bulky circuitry and components and the undesirable requirement for precisely matched channels or complicated and tedious trimming procedures and circuits.

SUMMARY OF THE INVENTION

The above disadvantages of the prior art devices are obviated by apparatus for use with a synchro device, the synchro device providing a plurality of modulated synchro output signals in response to an a.c. excitation signal applied to the excitation winding thereof. A multiplexer responsive to the plurality of modulated synchro output signals, time multiplexes the plurality of modulated synchro output signals onto the multiplexer output thereby providing time multiplexed modulated synchro output signals thereon. Demodulation circuitry responsive to the time multiplexed modulated synchro output signals demodulates the signals thereby providing demodulated time multiplexed synchro output signals. A demultiplexer responsive to the demodulated time multiplexed synchro output signals time demultiplexes the time multiplexed synchro output signals on to a respective plurality of the demultiplexer outputs. The multiplexer and demultiplexer are synchronized so as to provide a plurality of d.c. signals on the respective plurality of demultiplexer outputs which d.c. signals correspond to the respective demodulated synchro output signals.

DESCRIPTION OF THE PREFERRED EMBODIMENT

Figure 1:
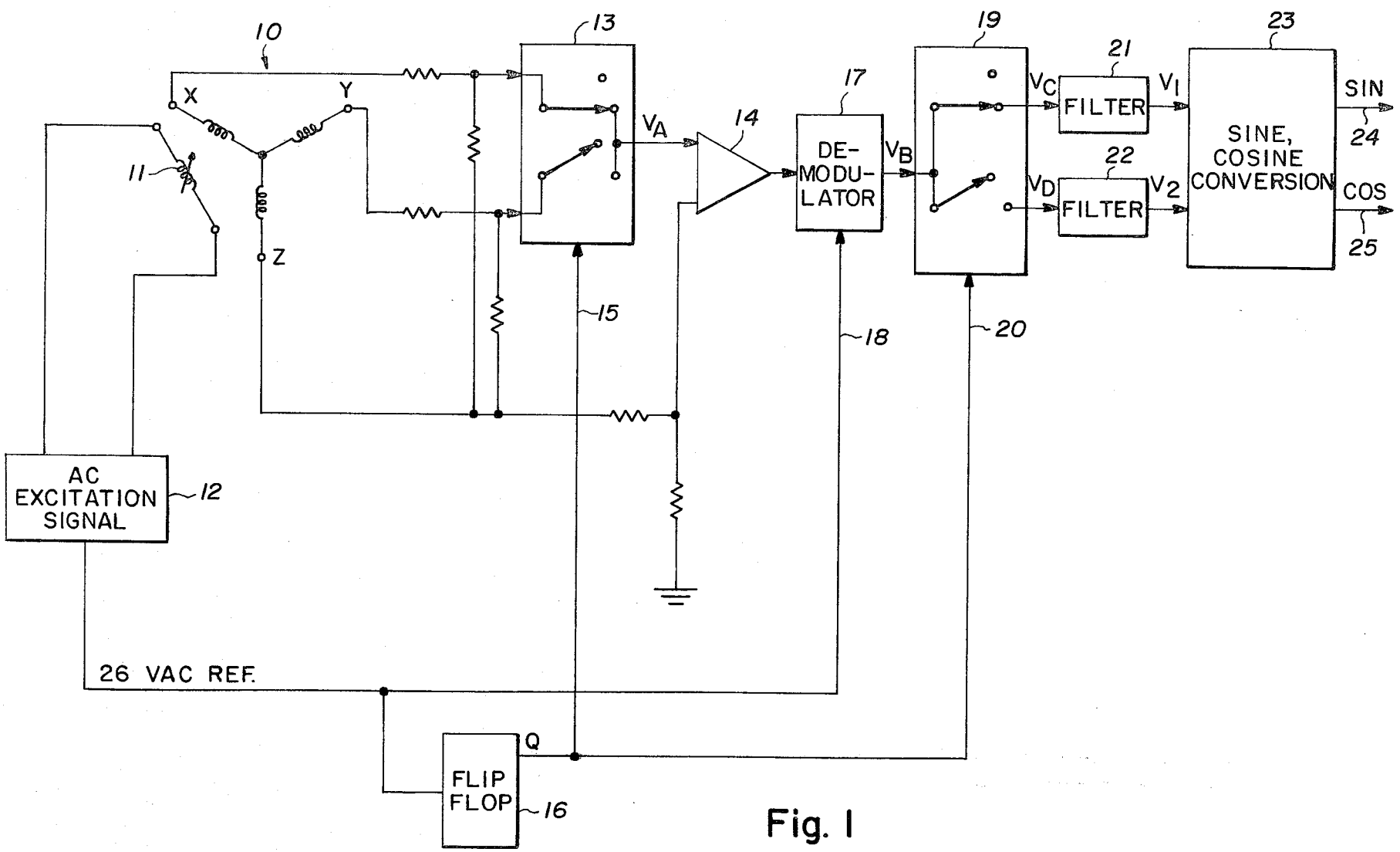
FIG. 1 is a schematic block diagram illustrating a preferred embodiment of the invention.
Figure 2:
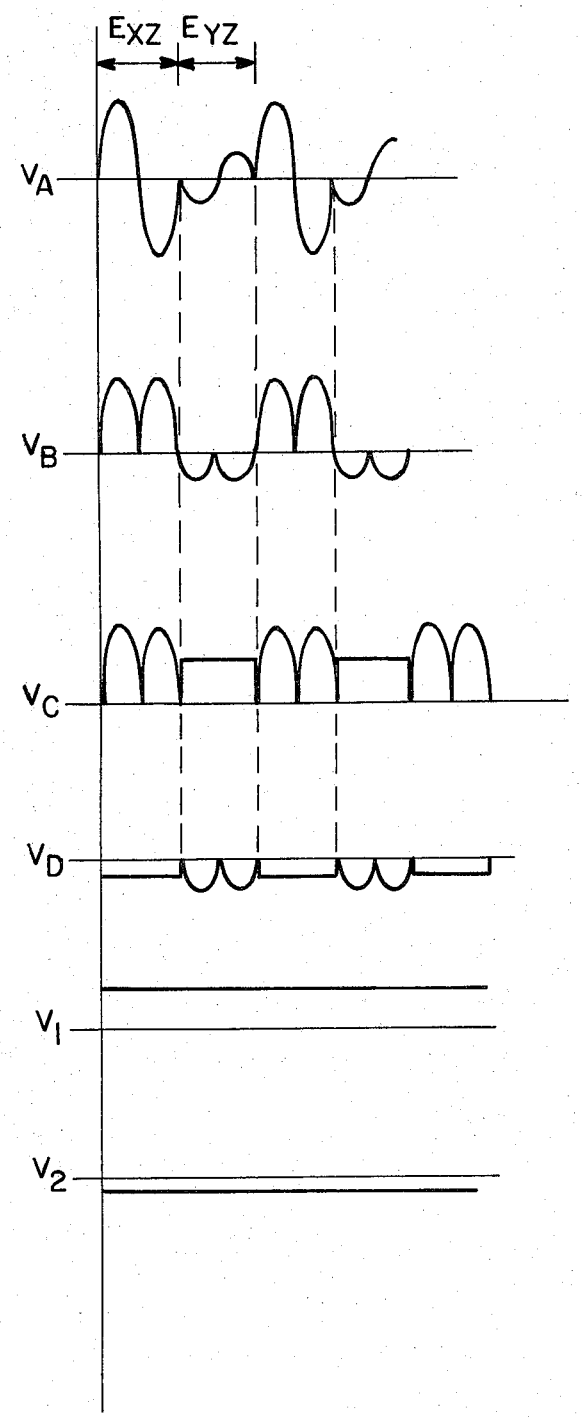
FIG. 2 is a waveform timing diagram illustrating waveforms at various points of FIG. 1.

Referring to FIG. 1, a schematic block diagram of the preferred embodiment of the invention is illustrated. Reference may also be had to FIG. 2 which illustrates waveforms at designated points of FIG. 1. A synchro device 10, such as the three-wire synchro illustrated, may be utilized to sense the angular position of a member (not shown) to which the rotor 11 of the synchro device 10 may be coupled. An a.c. excitation signal, typically a 400 cycle sinusoidal signal, is applied by an a.c. excitation signal source 12 to the excitation winding of the synchro device 10, which winding is typically wound on the rotor 11. The three-wire synchro device 10 also includes three stator windings x, y and z, which provide the synchro device three-wire output data. The a.c. excitation signal applied to the excitation winding of the device is coupled to the x, y and z windings providing three respective a.c. output signals amplitude modulated in accordance with the angular position of the rotor 11 and either in phase or out of phase with the applied a.c. excitation signal in accordance with the rotor position.

The output data provided by the synchro device 10 may be taken by providing the voltage across the x and z legs and the voltage across the y and z legs of the device, these voltages being designated as $E_{xz}$ and $E_{yz}$ respectively. One cycle of each of the $E_{xz}$ and $E_{yz}$ voltages is illustrated in FIG. 2 as the waveform $V_A$.

The x and y outputs from the synchro device 10 are coupled respectively to the two inputs of a multiplexer 13 and the output of the multiplexer 13 is coupled as an input to an operational amplifier 14. The z output of the synchro device 10 is also coupled as an input to the operational amplifier 14. The multiplexer 13 selectively couples either the x output or the y output of the synchro device 10 to the amplifier 14 in accordance with a synchronizing signal on a lead 15. Multiplexers such as the multiplexer 13 are commercially available in integrated circuit form which may, for example, be implemented by CMOS FET switches. As illustrated, the multiplexer 13 may be comprised of two single pole, single throw switches with the switch enable inputs wired together to receive the synchronizing signal on the lead 15.

In the preferred embodiment of the invention the synchronizing signal on the lead 15 is provided by a flip flop 16 which is toggled by a 26 volt a.c. reference signal provided by the signal source 12 and derived from the a.c. excitation signal applied to the synchro device 10. Thus the multiplexer 13 is controlled to couple the x and y outputs of the synchro device 10 to the amplifier 14 on alternate cycles of the a.c. excitation signal. The $V_A$ signal, therefore, applied to the amplifier 14 comprises alternate cycles of the $E_{xz}$ voltage and the $E_{yz}$ voltage described above. The signal $V_A$, therefore, comprises the time multiplexed modulated synchro output signals from the synchro device 10. The waveform $V_A$ for a typical position of the rotor 11 is illustrated in FIG. 2 and depicts the alternate cycles of $E_{xz}$ and $E_{yz}$.

The time multiplexed modulated synchro output signals $V_A$ from the operational amplifier 14 are applied to a synchronous demodulator 17 which receives its synchronizing signal on a lead 18 from the 26 VAC reference signal from the source 12. The synchronous demodulator 17 may be of any convenient design for synchronously demodulating the time multiplexed modulated synchro output signals $V_A$ to provide demodulated time multiplexed synchro output signals. The synchronous demodulator 17 therefore provides, for each of the time multiplexed component a.c. voltages of the $V_A$ waveform, a corresponding unfiltered d.c. signal of amplitude proportional to that of the corresponding modulated a.c. voltage and of polarity depending on whether the corresponding a.c. voltage is in phase or out of phase with the a.c. excitation signal. These demodulated time multiplexed synchro output signals provided by the demodulator 17 are denoted as $V_B$ and are illustrated in FIG. 2. It is appreciated from FIG. 2 that the component of $V_B$ corresponding to the $E_{xz}$ voltage is of positive amplitude corresponding to the in phase condition of $E_{xz}$ and of amplitude proportional to that of the $E_{xz}$ and that the component of $V_B$ corresponding to the $E_{yz}$ voltage is of negative polarity corresponding to the out of phase condition of $E_{yz}$ and of amplitude proportional to that of $E_{yz}$.

The demodulated time multiplexed synchro output signals $V_B$ from the demodulator 17 are applied as the input to a demultiplexer 19. The demultiplexer 19 selectively couples the input thereof to the two outputs thereof so as to time demultiplex the $V_B$ signal. A synchronizing signal on a lead 20 controls the demultiplexer 19 to switch in synchronism with the multiplexer 13 to provide the required time demultiplexing function. The signal on the lead 20 may be the same synchronizing signal provided on the lead 15 to the multiplexer 13 as provided by the flip flop 16. The unfiltered demultiplexed and demodulated signals provided on the outputs of the demultiplexer 19 are denoted as $V_C$ and $V_D$ respectively and are applied through respective smoothing filters 21 and 22 to provide corresponding filtered d.c. signals $V_1$ and $V_2$ respectively. The demultiplexer 19 may conveniently be implemented in a manner similar to that described above with respect to the multiplexer 13.

The signals $V_C$, $V_D$, $V_1$ and $V_2$ are illustrated in FIG. 2. By referring to FIG. 2 it is appreciated that in accordance with the implementation of FIG. 1 as described above, the $V_C$ signal corresponds to the time demultiplexed components of $V_B$ corresponding to the $E_{xz}$ voltage and the signal $V_D$ comprises the time demultiplexed components of the signal $V_B$ corresponding to the $E_{yz}$ voltages. The unfiltered demodulated $V_C$ signal when passed through the smoothing filter 21 provides the filtered d.c. voltage $V_1$ illustrated. The unfiltered demodulated signal $V_D$ when passed through the smoothing filter 22 provides the filtered d.c. signal $V_2$ illustrated. It is appreciated from the waveforms of FIG. 2 that when the input of the demultiplexer 19 is connected to one of its outputs, the other of its outputs experiences the open circuit voltage appearing on the filter capacitors of the associated smoothing filter. These open circuit voltages appear as constant level voltages intermediate the full wave demodulated segments of the $E_{xz}$ and $E_{yz}$ components of the $V_C$ and $V_D$ waveforms of FIG. 2.

It is appreciated from the foregoing that the voltage $V_1$ is the demodulated and filtered $E_{xz}$ synchro output signal and the voltage $V_2$ is the demodulated and filtered synchro output voltage $E_{yz}$. In accordance with a further aspect of the invention, the voltages $V_1$ and $V_2$ are applied to a Sine, Cosine conversion circuit 23 to provide the sine and cosine of the angular position of the rotor 11 of the synchro device 10 on output leads 24 and 25 respectively. The Sine, Cosine conversion circuit 23 may be embodied in any conventional manner by implementing the following equations (1) and (2) relating the sine and cosine signals to the voltages $V_1$ and $V_2$.

$$\text{Cos}\ \theta = \frac{V_1 + V_2}{E\sqrt{3}} \tag{1}$$

$$\text{Sin}\ \theta = \frac{V_2 - V_1}{E} \tag{2}$$

where E is an arbitrary gain constant.

For completeness the following is the manner in which the Equations (1) and (2) are derived:

$$E_{xz} = V_1 = E \sin(\theta - 120°)$$

$$E_{yz} = V_2 = -E \sin(\theta + 120°)$$

$$V_1 + V_2 = E[\sin(\theta - 120°) - \sin(\theta + 120°)]$$

$$= 2E \cos\theta \sin 120° = E\sqrt{3} \cos\theta$$

$$\text{Cos}\ \theta = \frac{V_1 + V_2}{E\sqrt{3}} \tag{1}$$

$$V_1 - V_2 = -E[\sin(\theta - 120°) + \sin(\theta + 120°)]$$

$$= -2E \sin\theta \cos 120° = E \sin\theta$$

-continued $$\sin\theta = \frac{V_2 - V_1}{E} \quad (2)$$

The conversion circuit 23 may be embodied utilizing discrete analog or digital components such as adders, subtracters, multipliers and dividers for implementing the arithmetic functions comprising the Equations (1) and (2). Alternatively, a programmed microprocessor may be utilized to the same effect. In a microprocessor controlled system the voltages $V_1$ and $V_2$ may be sampled and held, converted into digital format in an analog-to-digital converter, and applied to the microprocessor for conversion to the sine and cosine signals by a program implementing Equations (1) and (2).

The sine and cosine signals on the leads 24 and 25 respectively may be utilized to provide the tangent of the angular position of the rotor 11 of the synchro device 10 by dividing the sine signal by the cosine signal. It is appreciated from the above given Equations (1) and (2) that in performing the tangent computation the gain constant E is cancelled. In such systems, therefore, the constant E may be disregarded since it drops out of the computation. In sampled data systems utilizing the invention it is appreciated that the $V_1$ and $V_2$ signals need not be sampled or may be sampled conveniently at any arbitrary time since these voltages are steady d.c. signals.

Figure 3:
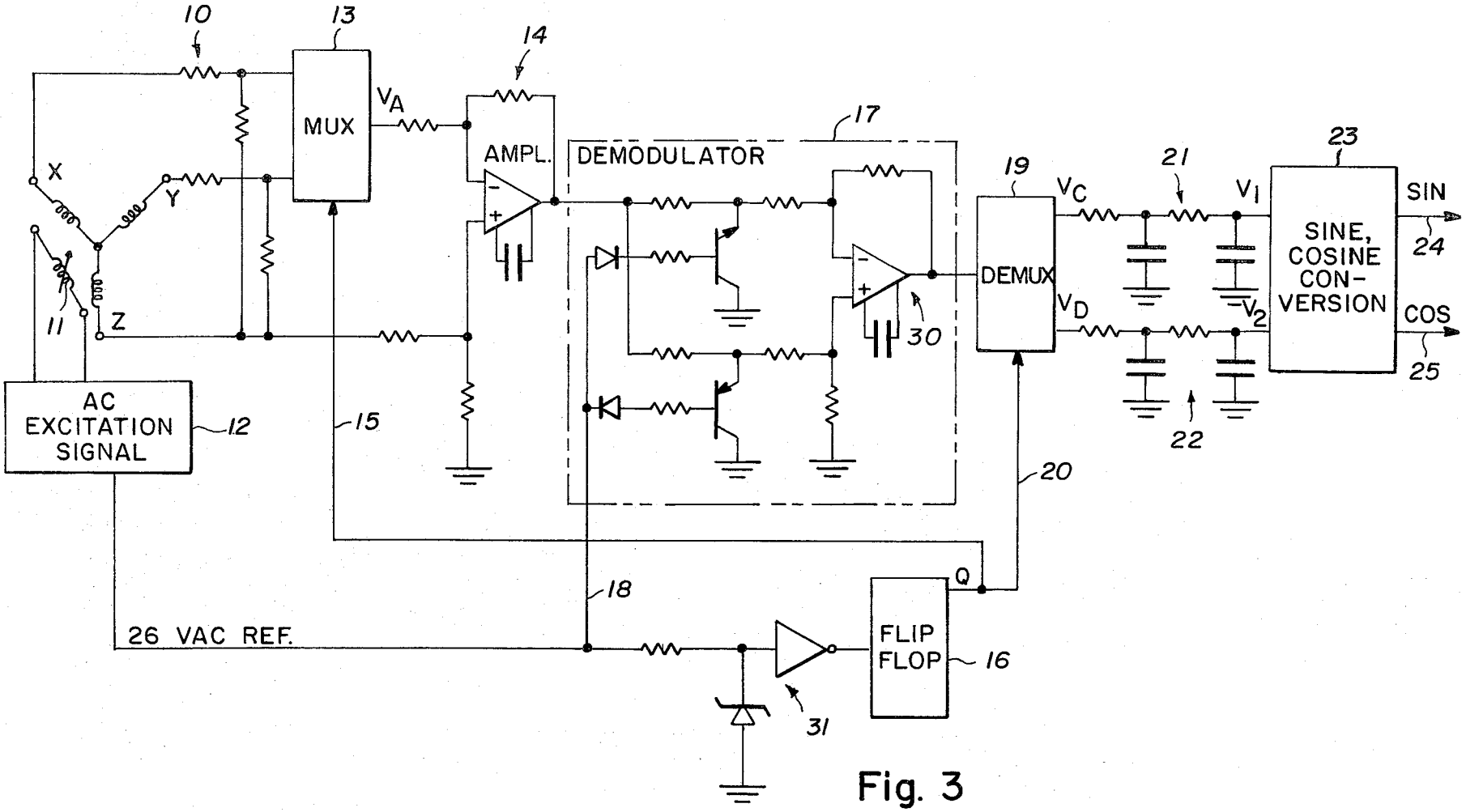
FIG. 3 is a schematic circuit diagram corresponding to the block diagram of FIG. 1.

Referring now to FIG. 3 in which like reference numerals indicate like components with respect to FIG. 1, circuit details of the components of FIG. 1 are illustrated. The above description of FIG. 1 is equally applicable to FIG. 3 and may be read in conjunction therewith for a more detailed understanding of the invention. In addition, it will be appreciated that the operational amplifier 14 may be a commercially available integrated circuit and that the demodulator 17 is implemented utilizing a similar operational amplifier 30. The 26 VAC reference voltage from the signal source 12 is applied to the toggle input of the flip flop 16 through a signal shaping circuit 31 for rendering the synchro type voltage provided by the signal source 12 compatible for triggering the flip flop 16. The smoothing filters 21 and 22 are conventional RC filters for providing the voltages $V_1$ and $V_2$. It is appreciated that the flat topped segments of the waveforms $V_C$ and $V_D$ of FIG. 2 are the open circuit voltages appearing on the illustrated filter capacitors of the filters 21 and 22.

As described above with respect to FIG. 1, the Q output of the flip flop 16 is utilized to synchronously switch the multiplexer 13 and demultiplexer 19 so as to provide the signals $V_C$ and $V_D$ as explained. It will be appreciated that alternatively the multiplexer 13 may be connected to the Q output of the flip flop 16 with the demultiplexer 19 connected to the $\overline{Q}$ output thereof. With such a connection the $V_C$ waveform will be applied to the filter 22 and the $V_D$ waveform will be applied to the filter 21. As a further alternative arrangement, the connections of the leads 15 and 20 to the Q and $\overline{Q}$ outputs of the flip flop 16 may be interchanged resulting in a corresponding interchange of the signals $V_C$ and $V_D$. Although the above described embodiment of the invention was explained in terms of synchronizing the multiplexer 13 and the demultiplexer 19 with respect to successive cycles of the synchro excitation signal, it is appreciated that the multiplexer 13 and demultiplexer 19 may be switched at a slower rate corresponding to plural cycles of the a.c. excitation signal. Such an implementation may involve utilizing a divide-by-N circuit in place of the flip flop 16.

The invention was described in terms of utilization with a three-wire synchro device. It is appreciated that the principles of the invention are also applicable to other synchro devices such as two or four wire resolver devices. Since resolver devices provide outputs in terms of sine and cosine, the conversion circuit 23 would not be utilized in such embodiments.

Although the above described embodiment of the invention is preferred, the invention may also be implemented utilizing a three-wire synchro device by converting the output of the synchro device to sine and cosine a.c. signals via a Scott-T transformer or an electronic Scott-T circuit and thereafter utilizing the present invention to provide only one channel of amplification and demodulation. In such an embodiment the Sine, Cosine conversion circuit 23 would not be utilized.

The present invention may, for example, find utility in a system such as that described in Applicants' assignee's co-pending U.S. patent application Ser. No. 129,133 filed Mar. 10, 1980, in the names of Harold L. Swartz and Joseph M. Buemi, entitled "Demodulatorless Synchro Position Sensor Apparatus Utilizing Square Wave Excitation" now U.S. Pat. No. 4,270,007, issued May 26, 1981. In the system of said Ser. No. 129,133, the voltages $V_1$ and $V_2$ may conveniently be applied as inputs to the analog multiplexer 28 of FIG. 1 of said Ser. No. 129,133 for sampling, analog-to-digital conversion and data processing in the microprocessor as discussed in said Ser. No. 129,133.

It will be appreciated from the foregoing that prior art apparatus required plural channels of amplification and demodulation to provide respective plural output signals such as the sine and cosine data provided by the apparatus of FIG. 1. Since the present invention utilizes only one channel of amplification and demodulation, any gain change that occurs in the channel affects the $E_{xz}$ and $E_{yz}$ signals in the same manner, thereby rendering the circuitry of the present invention insensitive to gain anomolies. Additionally, in a preferred embodiment of the invention where the sine signal is divided by the cosine signal to provide the tangent, gain anomolies that occur equally to both the sine and cosine signals do not affect the result of the computation. The present invention renders synchro apparatus of the type described substantially insensitive to gain discrepancies and changes.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. Apparatus for use with synchro device means, said synchro device means providing a plurality of modulated synchro output signals, said apparatus demodulating said plurality of modulated synchro output signals into a respective plurality of d.c. signals, comprising multiplexer means having a multiplexer output and responsive to said plurality of modulated synchro output signals for time multiplexing said plurality of modulated synchro output signals on to said multiplexer output, for providing time multiplexed modulated synchro output signals on said multiplexer output, demodulator means responsive to said time multiplexed modulated synchro output signals for demodulating said time multiplexed modulated synchro output signals, thereby providing demodulated time multiplexed synchro output signals, demultiplexer means having a plurality of demultiplexer outputs and responsive to said demodulated time multiplexed synchro output signals for time demultiplexing said time multiplexed synchro output signals onto said plurality of demultiplexer outputs, and means for synchronizing said multiplexer means and said demultiplexer means with respect to each other to provide said plurality of d.c. signals on said plurality of demultiplexer outputs, respectively.

2. The apparatus of claim 1 in which said synchro device means comprises a three-wire synchro device having first, second and third output terminals for providing three-wire synchro data signals, said plurality of modulated synchro output signals comprises first and second modulated synchro output signals, said first modulated synchro output signal being provided between said first and third output terminals and said second modulated synchro output signal being provided between said second and third output terminals, and said plurality of d.c. signals comprising first and second d.c. signals corresponding to said first and second modulated synchro output signals, respectively.

3. The apparatus of claim 2 in which said multiplexer means includes first and second multiplexer inputs coupled to receive said first and second modulated synchro output signals, respectively, said multiplexer means comprising means for alternately coupling said first and second multiplexer inputs to said multiplexer output, thereby providing said time multiplexed modulated synchro output signals.

4. The apparatus of claim 3 in which said demultiplexer means includes a demultiplexer input coupled to receive said demodulated time multiplexed synchro output signals, said plurality of demultiplexer outputs comprising first and second demultiplexer outputs, said demultiplexer means comprising means for alternately coupling said demultiplexer input to said first and second demultiplexer outputs, thereby providing said first and second d.c. signals on said first and second demultiplexer outputs, respectively.

5. The apparatus of claim 1 or 4 in which said synchro device means comprises a synchro device adapted to be excited by an a.c. excitation signal.

6. The apparatus of claim 5 in which said demodulator means comprises a synchronous demodulator responsive to said a.c. excitation signal for synchronously demodulating said time multiplexed modulated synchro output signals.

7. The apparatus of claim 5 in which said synchronizing means comprises means responsive to said a.c. excitation signal for synchronizing said multiplexer means and said demultiplexer means in time synchronism with said a.c. excitation signal.

8. The apparatus of claim 2 in which said synchro device includes a rotor, said first and second modulated synchro output signals being provided in accordance with the angular position of said rotor, said apparatus further including sine and cosine conversion means responsive to said first and second d.c. signals for providing sine and cosine signals proportional to the sine and cosine of the angular position of said rotor, respectively.

9. The apparatus of claim 8 in which said sine and cosine conversion means comprises means responsive to said first and second d.c. signals for providing the difference therebetween, to provide said sine signal, proportional to said difference, and means responsive to said first and second d.c. signals for providing the sum thereof to provide said cosine signal proportional to said sum.

10. The apparatus of claim 4 further including smoothing filter means coupled to said first and second demultiplexer outputs for smoothing said first and second d.c. signals.

11. The apparatus of claim 8 further including smoothing filter means coupling said plurality of demultiplexer outputs to said sine and cosine conversion means for smoothing said first and second d.c. signals.

* * * * *